United States Patent [19]

Bejerano et al.

[11] 4,155,639

[45] May 22, 1979

[54] FLEXIBLE BELT XEROGRAPHIC COPIER

[75] Inventors: Abraham Bejerano, Costa Mesa; Richard P. Wischnef, Huntington Beach, both of Calif.

[73] Assignee: A. B. Dick Company, Chicago, Ill.

[21] Appl. No.: 794,942

[22] Filed: May 9, 1977

[51] Int. Cl.[2] ..... G03G 15/00

[52] U.S. Cl. ..... 355/3 BE; 101/415.1; 355/16

[58] Field of Search ..... 355/16, 3 R, 3 BE; 101/415.1, 378; 74/221-229

[56] References Cited

U.S. PATENT DOCUMENTS

| | | | |
|---|---|---|---|
| 3,603,255 | 9/1971 | Horner | 101/415.1 X |
| 3,797,930 | 3/1974 | Tanaka et al. | 355/16 X |
| 3,877,806 | 4/1975 | Schrempp et al. | 355/16 |
| 3,879,123 | 4/1975 | Fisher | 355/3 BE |

*Primary Examiner*—R. L. Moses

*Attorney, Agent, or Firm*—Peter S. Lucyshyn

[57] ABSTRACT

A xerographic copier including a novel photoconductive belt and drive structure is disclosed. The thin metal belt is provided with at least one transverse break or gap and is preferably formed of two belt segments. In use, the break or gap between segments are held in end-to-end relationship by tow bars which captivate the edges of the segments, hold them in position and provide mechanical bias therebetween. The photoconductive belt is driven in a unique manner by means of the tow bars which are drawn about a non-circular path by an inelastic but flexible guide means such as chains and sprockets. The belt passes over drums which support the belt and define it's path but do not drive it. The drums include a low friction surface and provision (a soft layer) for accommodating small foreign objects that may pass between the belt and the drums without hurting the belt. The tow bars project only on the inner side of the belt and provision is made for accommodating them on the drums so as to not excessively bend the photoconductor bearing surface of the belt. This provision is at least one channel in each drum which are driven in synchronism with the tow bars and so sized and spaced as to have the channels receive the tow bars as they travel about the path.

31 Claims, 14 Drawing Figures

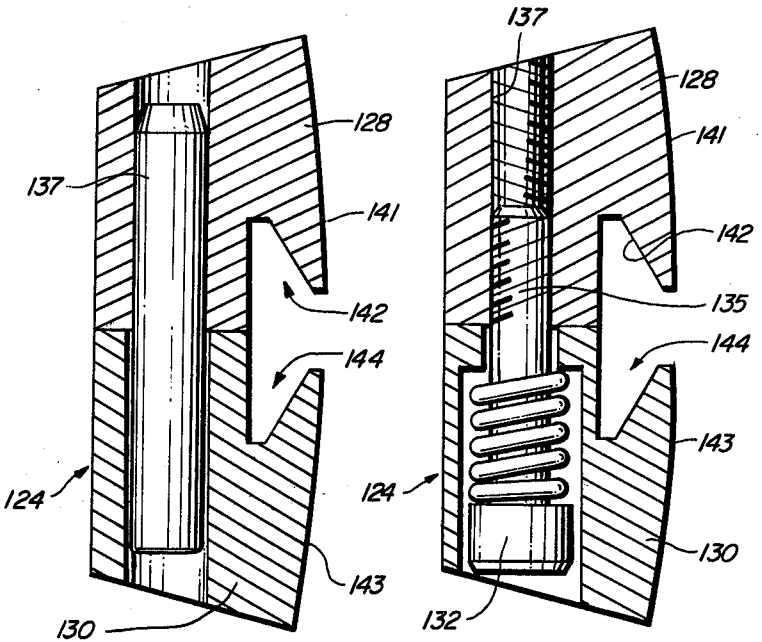
FIG-7
FIG-6
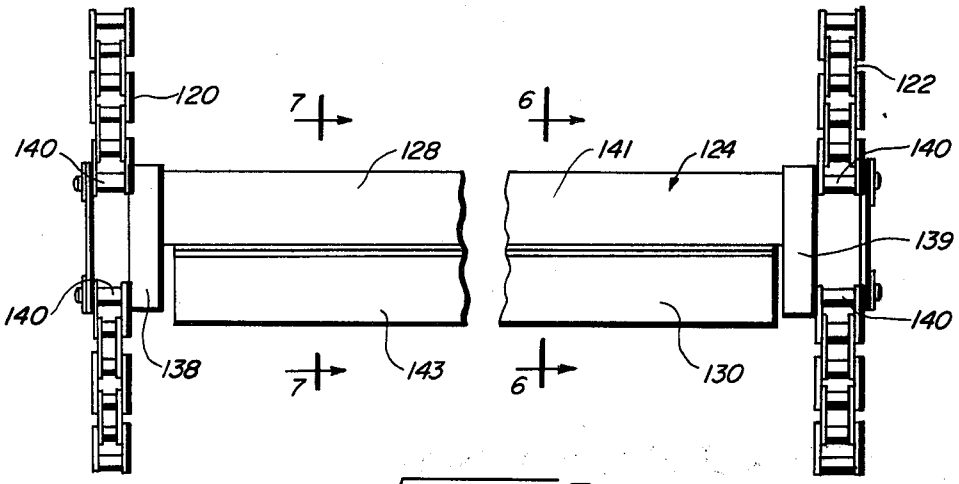
FIG-5
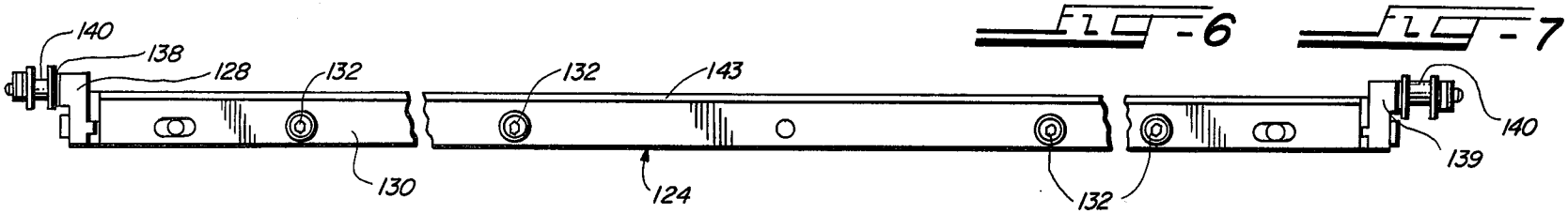
FIG-8

FLEXIBLE BELT XEROGRAPHIC COPIER

BACKGROUND OF THE INVENTION

This invention relates generally to xerographic-type copiers using photoconductive belts as the image medium and more particularly to a mounting arrangement for a segmented photoconductive belt for use in a xerographic or the like copier.

Electrostatic or xerographic-type copiers employing photoconductive segments mounted on endless belts and carried thereby past copy stations for imaging are known in the art. Such an arrangement is shown in U.S. Pat. No. 3,792,924, issued Feb. 19, 1974. That patent discloses an electrophotographic copying system which employs parallel spaced, endless belts between which light sensitive sheet segments are detachably attached at intervals thereabout. The belts are entrained about spaced rollers used to move the belts along an endless path. The sheet segments are transported by the moving belts past copier units provided for imaging the segments electrostatically, developing the electrostatic image and for transferring the image to a sheet of paper.

The segments are attached to the belts by means of rods which are passed through pockets formed at the ends of the segments. The ends of the rods are detachably received in channel-shaped supports affixed to the belts outside the path of travel of the segment.

While this arrangement for attaching photoconductive segments to endless drive belts in a copier may be satisfactory in some applications, there are certain disadvantages associated therewith. For one, due to the use of the channel-shaped supports which engage the rod ends, it becomes necessary to cam away the magnetic brush developer roll employed for developing the latent image on the segments as the ends of the segments pass thereby. This is to avoid application of developer material to the rod coupling means and thereby contaminating the machine components with such material. The latter disadvantage becomes even more critical in the case of a high speed copier wherein a multi-roll magnetic developer is employed. Also, because the support rods extending through the pockets of the photoconductive segments are attached only at the ends thereof, a non-uniform holding force across the ends of the segments is provided. This causes the segments to sag somewhat at the center thereof. This can be detrimental since optimum resolution requires the focal plane of the image and the photoconductive surface to be common.

Other printing plate mounting schemes for mounting metal or the like printing plates on the master cylinder of an offset or the like press are also known in the art, See U.S. Pat. Nos. 3,946,670; 3,941,055; and 3,970,001. These arrangements employ spaced bars extending axially of the cylinder along the surface thereof which include angled slots to receive the bent back edges of the metal plates for securing the plates on the cylinder surface. In the '670 patent, a spring loaded bar is provided at one end for tensioning of the plate while in the '001 patent a toggle arrangement is used for that purpose.

While these last-mentioned mounting schemes provide a uniform tension on the printing plate across the entire width thereof, they are employed to maintain the plate on a rigid substrate and not to suspend the plate between endless belts which carry the plate along a path between two drive rolls.

In a relatively wide photoconductor belt which is driven over rollers wherein there is a relatively short length to width ratio there exists a problem with "walking" or the tendency of the belt to move axially along the drums or rollers. This problem has been dealt with by a number of approaches, such as specially shaped rollers or by detecting the walking controlling and adjusting devices. These approaches are relatively complex, or introduce special problems for a photoresponsive copier belt.

SUMMARY OF THE INVENTION

Briefly, a preferred embodiment of the segmented photoconductive belt mounting arrangement according to the invention includes a pair of endless belts, chains or the like entrained about sprocket wheels provided at the ends of a pair of spaced rotatable cylindrical drums or rolls. Between the chains, spaced at equal distances from each other therealong, are provided a pair of tow bars. Each bar comprises a first bar section extending between and attached at the ends thereof to the chains and a second bar section which is attached by spring loaded screws at intervals therealong to the first section. The bar sections define opposing angled slots or grooves therein.

Two metal belt segments each having a photoconductive layer thereon are accommodated by the mounting arrangement in an end-to-end relation to form an endless photoconductive belt. The ends of each of the belt segments is reversely bent for receipt in one of the grooves of each of the tow bar sections, a first end being received in the slot in the first section of one tow bar and the opposite end of the segment being received in the slot of the second section of the other tow bar.

To install the segments on the tow bars as described, a locking mechanism is provided to move one of the drums about which the endless chains are entrained, from a first operative position to a second inoperative position, nearer the other drum. The latter movement slackens the chains to permit the ends of the segments to be received in the slots of the respective tow bars. Returning the drum to the operative position tightens the chains to secure the segment ends in respective slots of the tow bar sections. The spring loaded bar sections provide proper tensioning to the belt segments despite slight variations in the lengths thereof.

Because it is advantageous that development and transfer of the images on the photoconductive belt segments take place while the segments travel over the surfaces of the drums, respectively, it is important that the segments are maintained in intimate contact with the drum surfaces as they pass thereover. To ensure the latter, the drums include axially aligned recesses into which the tow bars are received as they become aligned therewith. In order to ensure proper alignment of the recesses in the drums, and continual movement of the belt, the circumference of each of the drums in the preferred embodiment of the assembly described is equal to the length of a photoconductive segment or the center-to-center distance (pitch) between the tow bars. With the latter relationship met, the segments are carried along the endless path between and over the drum surfaces properly with no interference.

In the case of alternative embodiments of the assembly which fall within the scope and spirit of the subject invention wherein a plurality of drums and a single belt segment and a single tow bar, or a plurality of belt segments and a plurality of tow bars is employed, the belt segment length or pitch of the tow bars (where there is more than one tow bar) must equal a multiple or submultiple of the circumference of the smallest diameter drum in the assembly and the assembly must include two or more drums of which the diameter of any one of the drums is equal to or is a multiple or submultiple of any other one of the drums of the assembly. It is preferred in any belt mounting and transport assembly according to the invention to always have a tow bar received in a drum recess. It is undesirable to permit a belt segment to pass over an empty recess, as the portion of the belt overlying the recess will become flattened as it will have no drum surface backing. In a copying machine wherein a copying operation such as for example development or transfer of the image, takes place while the segment is overlying an unfilled recess of the drum, such a flattened area could ruin the image. Accordingly, it is important that an image area of a belt segment not be overlying an open recess in the drum surface.

In accordance with a more specific aspect of the present invention, there is a drum recess to receive a tow bar assembly each time the tow bar engages one of the drums, even though the drums may be of unequal diameter and there may be three or more drums for supporting the photoconductive belt, provided however, that the drum diameters are related such that one is a multiple (2×, 3×, etc.) or submultiple (½×, ⅓×, etc.) of the other and the belt segment(s) (there may be only one) have a length that is a multiple of the diameter of the smallest drum. As described above, the tow bars 122, 124, have their opposite ends attached to the chains 120, 122, to maintain appropriate tension in the photoconductive belt during normal operation. During assembly of the copy machine, as the chains are about to be mounted, the drums are rotated to a predetermined angular position relative to each other to assure that the distance along the chain from the tow bar to the drum recesses will result in the tow bars being picked up by the recesses as the chain drives the drums. Once each of the drums is angularly properly oriented relative to its chain drive, the foregoing relationship assures that there is a drum recess 156 to receive a tow bar assembly each time a tow bar engages one of the drums.

It is undesirable to have an unsupported portion of the segment span a drum gap such as that presented by a drum recess. That could occur, for example, in a machine using only one belt segment which requires only one tow bar assembly and that belt segment is trained about two drums, each of which has a recess to accept the tow bar when the latter engages the drum if a second non-functional tow bar is not provided.

The surfaces of the drum and/or the photoconductive segments which are in contact with one another are coated with a low friction material such as Teflon. The last-mentioned material reduces the frictional force between the drum surface and photoconductive segment to allow limited slippage sideways of the belt on the roller. Furthermore, to minimize damage to the photoconductive surface of the belt segments due to foreign objects becoming lodged between the belt segments and drum surfaces, an outer layer of each of the drums is formed of a relatively soft material. In this manner, a foreign object will tend to be absorbed by the drum surface rather than the belt segment, thereby avoiding damage to the latter.

DESCRIPTION OF THE DRAWINGS

In the drawings:

FIG. 5 is an enlarged plan view of a tow bar included in the photoconductive belt mounting and transport assembly according to the invention for attaching a photoconductive belt segment to drive chains employed for carrying the segment along a predetermined path past the various copying stations in a copying machine;

FIG. 6 is a cross-sectional view of the tow bar of FIG. 6 taken along the line 7—7;

FIG. 7 is a cross-sectional view of the tow bar of FIG. 6 taken along the line 8—8;

FIG. 8 is a front elevation of the tow bar of FIG. 6;

DETAILED DESCRIPTION OF THE DRAWINGS

Figure 1:
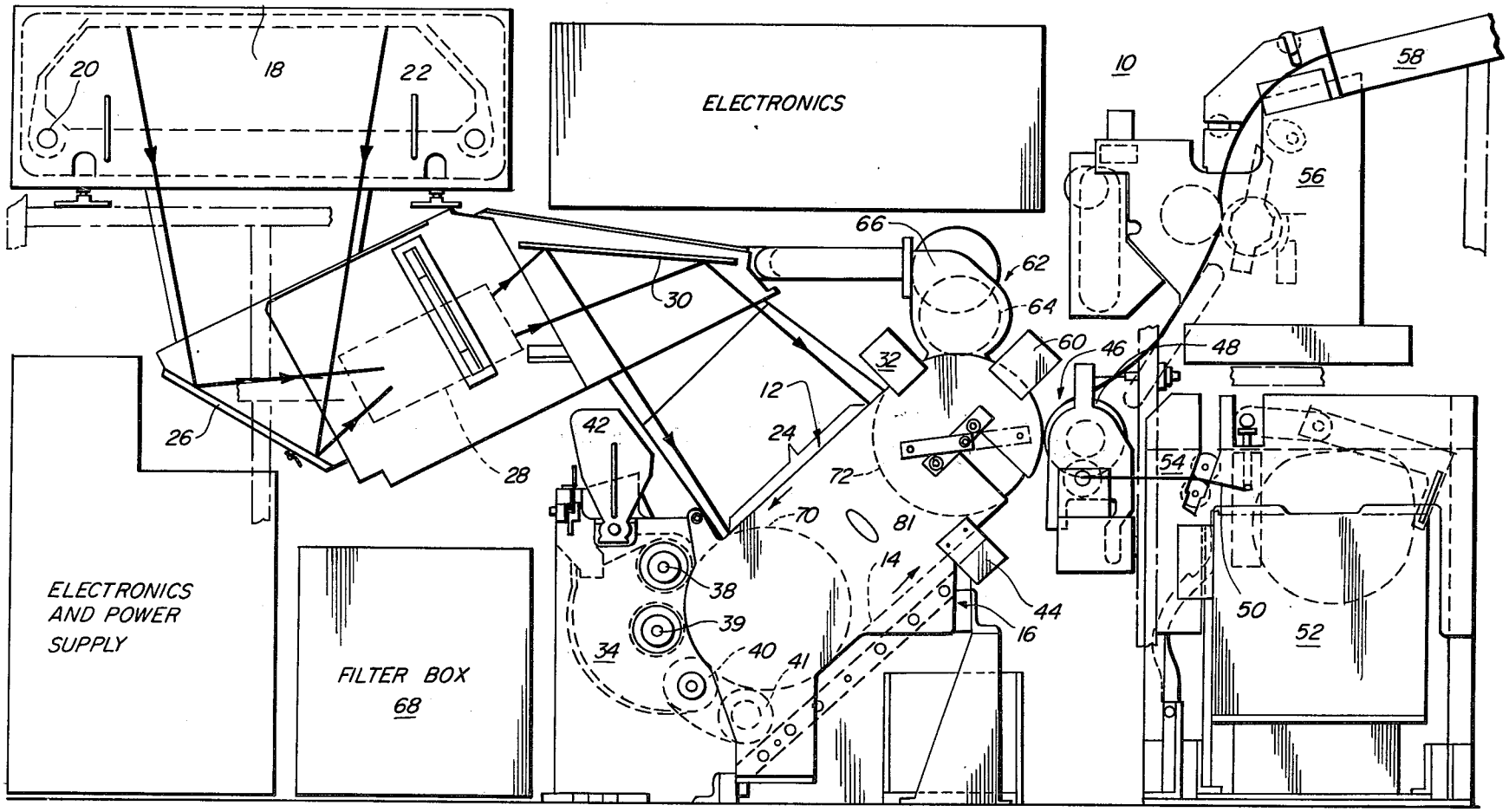
FIG. 1 is a side view, partly in section, of a xerographic or the like copying machine including a preferred embodiment of the assembly according to the invention for mounting and transporting a segmented photoconductive belt along a predetermined path past the various copying stations of the machine.
Figure 9:
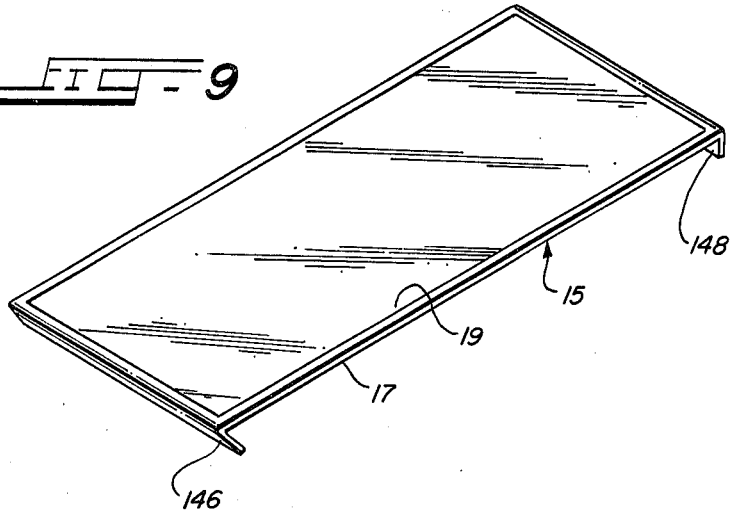
FIG. 9 is a perspective view of a photoconductive belt segment which is mounted on and transported by the photoconductive belt mounting and transport assembly according to the invention.

Referring now to the drawings in greater detail wherein like numerals have been employed throughout the various views to designate similar components, there is illustrated in FIG. 1 a xerographic or the like type copying machine 10 which includes in accordance with one feature of the present invention, a photoconductive segmented belt 12 mounted for movement along an endless path 14 in the direction of the arrow, past various copying stations. The segmented belt 12 is comprised of a pair of belt segments, such as 15 (FIG. 9) mounted in end-to-end relation for movement as described by means of the belt mounting and transport assembly 16 according to the invention. Each of the belt segments is formed of a thin sheet 17 of metal such as, for example, stainless steel and has a layer 19 of photoconductive material, such as selenium, coated on one surface thereof. The belt is driven, during use, at a constant speed.

As the present invention is primarily directed toward improvements in the belt 12 and assembly 16, systems and structures cooperating therewith such as the optical system, the overall controller, the developer and the paper handling subassembly, have been generally described only. These structures are state-of-the-art and easily modifiable by a person skilled in the xerographic copier art, once he has read the description of the present invention that follows, to adapt them to the present invention.

The copying machine 10 includes a glass platen or station 18 upon which original documents to be copied are placed. Exposure lamps 20, 22 are provided at the sides and below the platen to illuminate the original document and in so doing project the image of the original to expose the photoconductive belt in an exposure area 24. The exposure of the belt area takes place while the belt is in motion. The lamps 20, 22 are high intensity xenon or the like flash lamps which can expose the photoconductive layer of the belt substantially instantaneously.

The light image of the original document is reflected by a mirror 26, focused through a lens assembly 28 onto a second mirror and reflected therefrom to area 24 on the moving photoconductive belt. The extreme light ray paths are depicted in FIG. 1. The copier 10 has timing controls coupled to the drive assembly to be discussed below so that the image is projected on the photoconductive layer of the belt segments 15 and not on its end portions.

Prior to exposure of the photoconductive belt area, the latter is charged by means of the corona charging unit portion of the corona and lamp assembly 32. The lamp portion of the assembly is employed to discharge the edges of the photoconductive surface. After exposure of the belt area, the belt is transported through the developer station 34 whereat a magnetic brush developer assembly 36 including developer rolls 38, 39, 40 and 41 applies developer material to the charge image. A toner dispenser 42 replenishes toner to the developer assembly 36 used in development of images formed on the photoconductive belt.

Once developed, the image area 24 of the photoconductive belt is transported past a pretransfer corona and lamp assembly 44 which serves to loosen the hold of the developed image on the photoconductive belt prior to transfer.

The developed image is transferred at transfer station 46 whereat an electrically biased transfer roller 48 is provided to attract the developed image from the belt 12. A sheet of plain paper 50 which may be bond paper or any other suitable type from a stack 52 is fed about the roller 48 by sheet feeding assembly 54 between the roller 48 and the belt 12. The electrical bias on the roller 48 aids in attracting toner from the belt onto the bond sheet. The sheet is thereafter carried through fusing station 56 whereat there is provided a roll fuser of a conventional type which fixes the developed image onto the sheet. After fusing takes place, the completed copy is carried out of the machine into a tray 58.

The area 24 of the photoconductive belt 12 continues to be moved past a corona-lamp assembly 60 which loosens any residual toner left on the belt area. The residual toner is removed from the belt surface by a cleaning assembly 62 comprising a brush 64 and vacuum system 66 for such purpose. The removed toner is carried by the vacuum system 66 to a catch or filter box 68 at the bottom of the machine housing. The belt area has now completed the movement along the endless path 14 and is ready to be recharged by the corona and lamp assembly 32. As mentioned heretofore, assembly 32 includes a lamp which discharges any residual charge remaining on the belt surface prior to recharging by the corona device.

It should be noted that developing and transfer of the image formed on the photoconductive belt 12 are carried out as the belt is moved about the surface of the spaced drums or rollers 70, 72, respectively. The drums or roller 70, is of a relatively large diameter to provide sufficient surface area for engagement by the rolls of the magnetic brush developer assembly. As will be explained hereinafter, in the preferred embodiment of the assembly according to the invention, the circumference of each of the drums is substantially equal to the length of one of the photoconductive belt segments which form the photoconductive belt 12 used in the copying machine. In one prototype which was constructed in accordance with the invention, drums of a diameter of approximately 7½ inches were successfully employed.

Also depicted in FIG. 1, in a general manner are the electronics, such components and power supply which may be entirely conventional and do not form part of this invention and are thus not described here.

Figure 2:
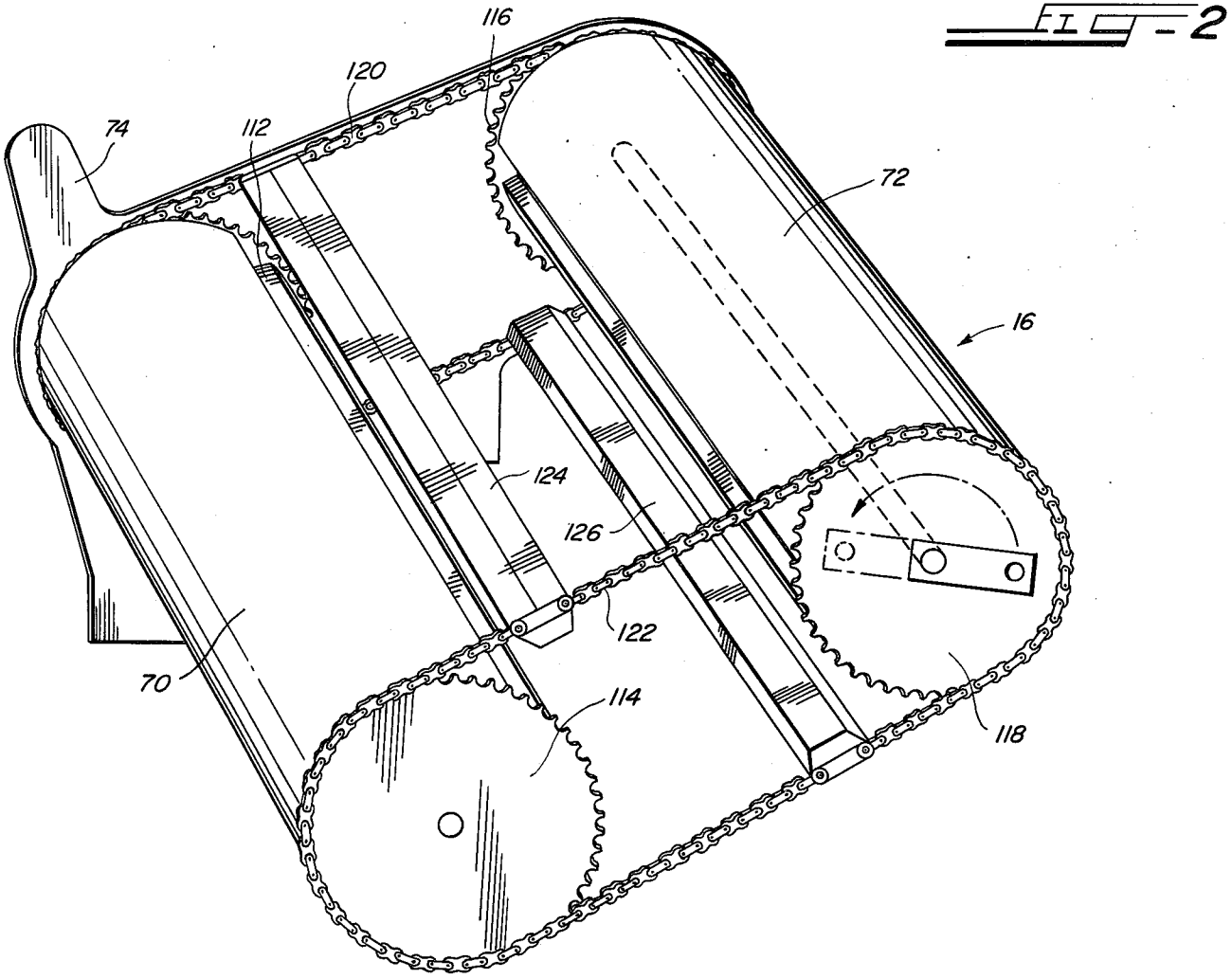
FIG. 2 is a perspective view of the photoconductive belt mounting and transport assembly of FIG. 1 with the belt and other parts removed so as to show the interior construction of the assembly.
Figure 3:
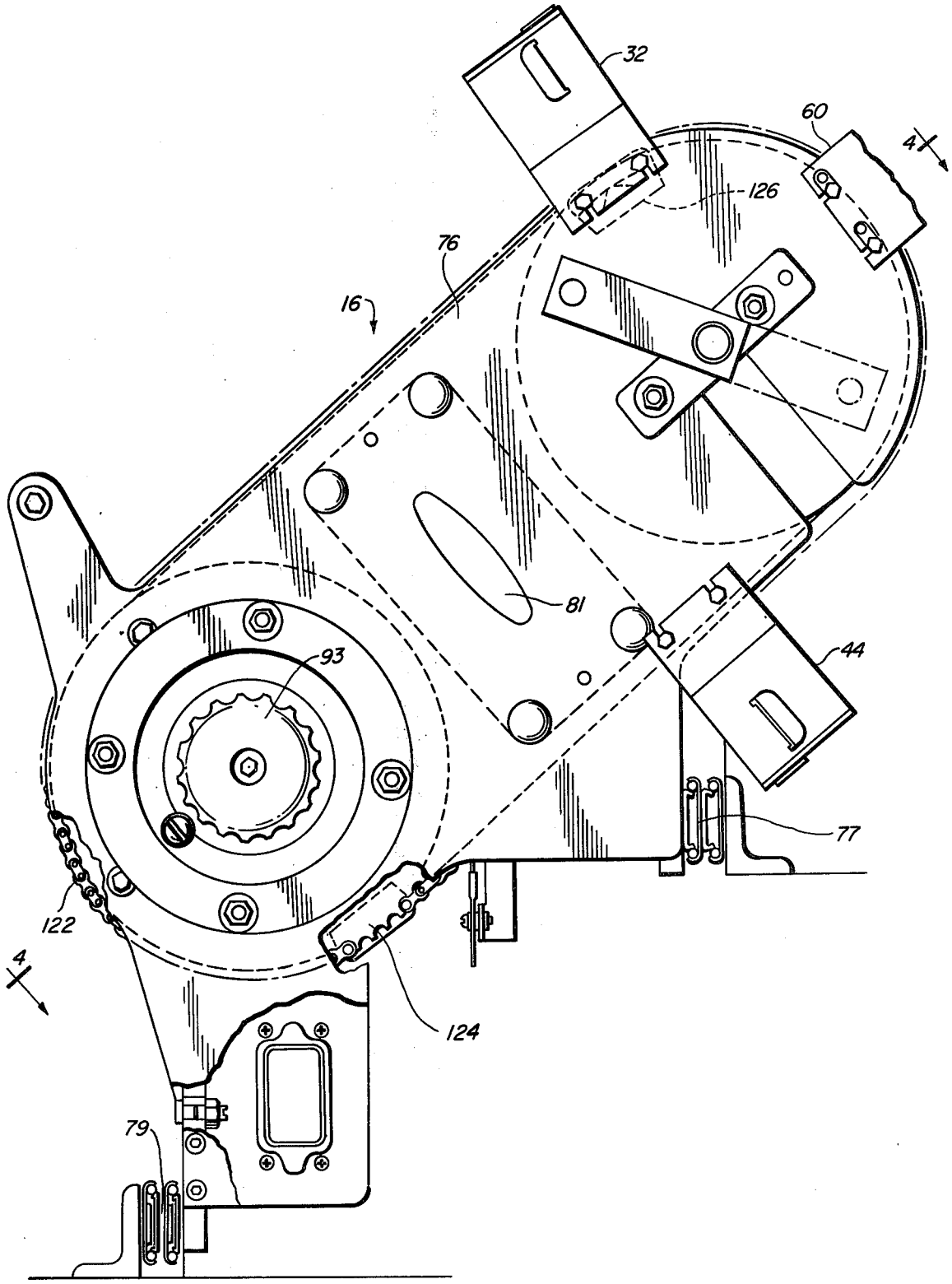
FIG. 3 is an elevational side view of the photoconductive belt mounting and transport assembly of FIGS. 1 and 2 with parts broken away to show interior parts and with other parts shown in phantom outline.

Referring now to the other figures of the drawings, there is shown therein in greater detail, the belt mounting and transport assembly 16 according to the invention. As can be seen in FIGS. 2 and 3, the transport drums 70, 72 are mounted for rotation between side support plates 74, 76. The assembly 16 is mounted for sliding movement into and out of the copying machine transverse to the direction of normal operational travel of the belt segments on slide mechanisms 77, 79 attached to side plates 74, 76. As such, an operator can slide the entire assembly out of the machine to change belt segments and to service the assembly. A handle 81 (FIG. 3) located between the drums on plate 76 is provided for manually sliding the assembly into and out of the copying machine. A suitable locking assembly (not shown) is employed to secure the assembly 16 in a locked position in the machine.

Figure 4:
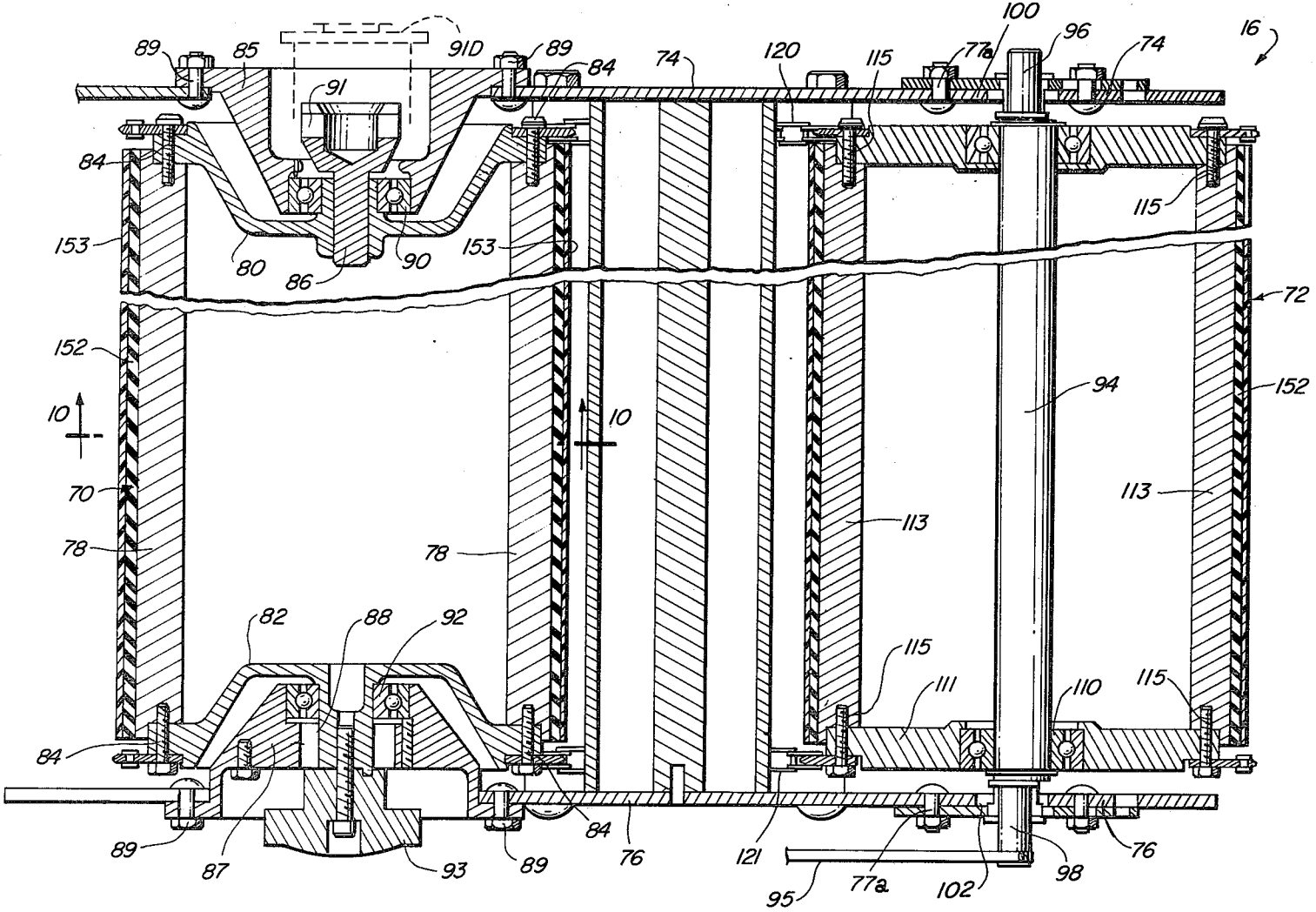
FIG. 4 is a cross-sectional view of the photoconductive belt mounting and transport assembly of FIG. 3 taken along the line 4—4 thereof.

The drum 70 as best shown in FIG. 4, includes an outer cylinder portion 78 and a pair of bell-shaped end pieces 80, 82, bolted by suitable fasteners such as 84, to the cylinder portion 78. Complementarily shaped mounting pieces 85, 87 are attached by suitable fasteners, such as bolts 89, to side support plates 74, 76, respectively. Each mounting piece includes a ball bearing assembly 90, 92, respectively. Stub shafts 86, 88 extending from respective drum end pieces 80, 82 are received for rotation in the ball bearing assemblies. A drive shaft connector 91 is provided on shaft 86 for engaging a drive member 91D (shown in phantom outline) when the assembly is locked into position in the copying machine. The drive member applies a rotational force to the drum 70 via connector 91. A handle 93, better seen in FIG. 3, extends from stub shaft 88 and is provided for manual rotation of the drum for aligning the drive shaft connector 91 with the drive member.

Drum 72 is mounted somewhat differently than drum 70. The drum 72 is mounted for rotation on a central non-rotating shaft 94 (See FIG. 4) extending axially through the drum. The ends 96, 98 of the shaft are received in apertures 100, 102 provided in the side plates 74, 76, respectively. Shaft supporting assemblies 104, 106, are fastened on support plates 74, 76, respectively, by suitable fasteners such as *77a* to secure the shaft ends in position on plates 74, 76. Ball bearing assemblies 108, 110 are provided in the end pieces 109, 111, respectively, of the drum 72. The end pieces 109, 111, are attached to the outer cylinder portion 113 of the drum by bolts 115. The drum 72 is mounted on shaft 94 as shown for rotation thereabout. The shaft 94 is mounted along a line eccentric with respect to the axis of rotation of drum 72. The shaft can be rotated 180° by a handle 95 provided thereon and accessible to an operator (FIGS. 2 and 3) to physically reposition the drum 72 nearer drum 70. The repositioning of the drum 72 is necessary for attaching the photoconductive belt segments onto tow bars to be described hereinafter.

As best shown in FIGS. 2 and 4, at the ends of each of the drums 70, 72, there are attached sprocket wheels 112, 114 and 116, 118, respectively, (See FIG. 2). Non-expanding flexible endless driving and guiding members taking the form of chains 120, 122 are entrained about the sprocket wheels as shown in the drawings. The wheels 112, 114, 116, 118 serve as means to fix the path of the non-expanding tow bar guide members or chains 120, 122. The chains traverse the endless path 14 as illustrated in FIG. 1. The chains and wheels together serve as means for defining the path 14 for the belt 12.

Between the chains there is mounted a pair of tow bars 124, 126, (See FIGS. 2 and 3). The center-to-center distance between the tow bars or pitch is substantially equal to the length of the photoconductive belt segments 15 which are supported thereby and extend therebetween.

Referring to FIGS. 5–8, the tow bar 124 which is identical to tow bar 126, is shown in greater detail. The tow bar comprises a pair of elongated bar sections 128, 130 which are joined together by a plurality of spring loaded screw assemblies such as 132, spaced along the length of the bar sections at various locations. Screws 135 (FIG. 7) are received in threaded apertures such as 137 in the bar section 128 to join the bar sections together. At other locations along the tow bar, slide pins such as 137 (See FIG. 6) are provided. The pins ensure uniform sliding of the bar sections with respect to each other. Springs 136 of the spring loaded screw assemblies, as will be shown, tension the photoconductive belt segments supported thereby.

The tow bar section 128 includes at the ends thereof integral mounting brackets 138, 139 which attach the tow bars 124, 126 to the endless chains 120, 122 (See FIG. 5). The mounting brackets form a link of the chain, and are attached thereto by appropriate pins such as 140 received in the links. The tow bar section 130 is movable away from the section 128 against the spring bias provided by the springs 136 of the assemblies 132.

The outer surfaces 141, 143 of the tow bar sections 128, 130, respectively, are curved to approximate the curvature of the surfaces of the drums about which they pass. In the case wherein drums of different diameters or circumferential lengths are employed, it is advantageous to provide a curvature on the tow bar sections which approximates the curvature of the smaller diameter drum. This will avoid creasing of the photoconductive belt segments as they are transported over the drum surfaces when the tow bars are received in recesses provided therefor in the drum surfaces, which will be described hereinafter.

Figure 11:
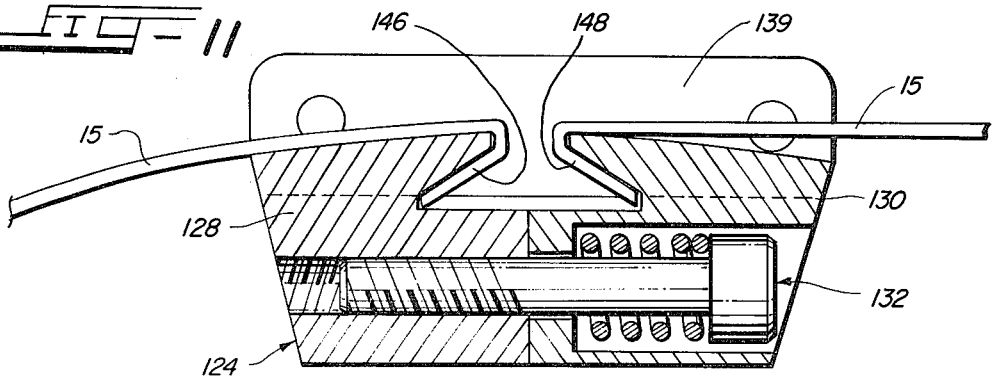
FIG. 11 is an enlarged sectional view of a tow bar included in the belt mounting and transport assembly according to the invention illustrating the attachment thereto of a pair of belt segments.

Each of the tow bar sections defines a reverse slot or groove 142, 144 (See FIGS. 6 and 7) formed therein to receive, as best seen in FIG. 11, the reversely bent edges 146, 148 of the photoconductive segment 15 comprising a section of the photoconductive belt 12.

The tow bars 124, 126 extend from the chains 120, 122 toward the surface of the drums as they are carried thereabout. To accommodate the tow bars, a recess or channel such as 156 (FIG. 10) is formed in each of the drum surfaces. Thus, as the tow bars 124, 126 are transported over the surface of the drums, they are received in the recesses which become aligned therewith. Such recesses extend axially of the drums and are of a depth to ensure that the photoconductive belt segment lies directly on and engages the drum surface. The latter is important as the belt segment requires the drum surface as a backing during copier operations such as development and transfer which take place while the segment is overlying the drum surface. The tow bars are mounted at predetermined locations along the chains 120, 122 to ensure the registry thereof with the recesses as the drums are rotated.

Figure 10:
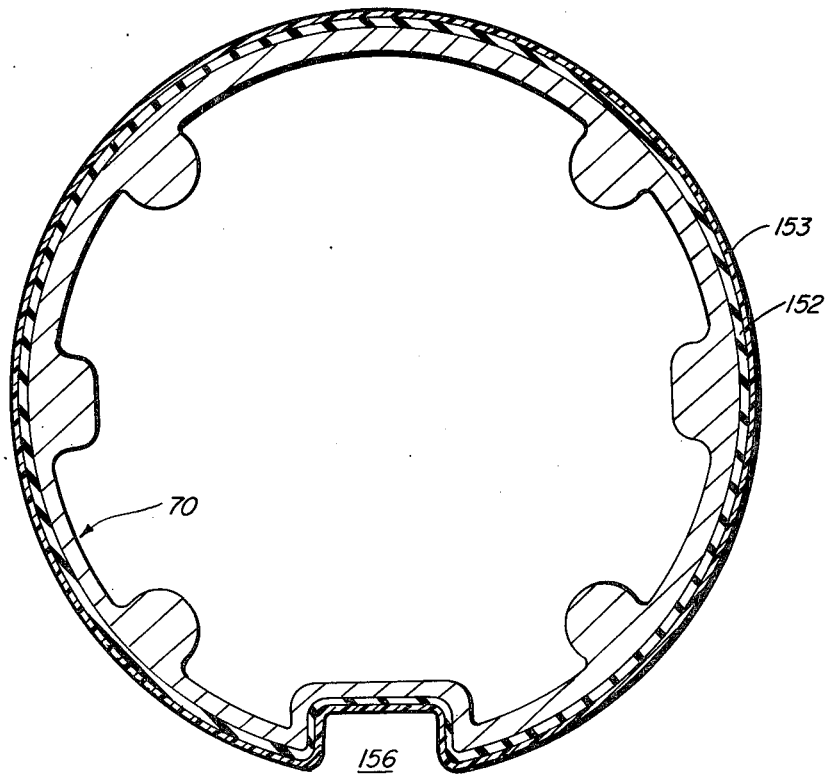
FIG. 10 is a cross-sectional view taken along line 10—10 in FIG. 4 of the transport drum employed in the photoconductive belt mounting and transport assembly with interior parts not shown.

Looking at FIG. 10 of the drawings, it will be seen that in the exemplary embodiment, the outer surface of the drum is covered with a layer of relatively soft spongy material 152 such as rubber or the like. This is to protect the belt sheet segments from becoming damaged or dented by foreign objects which may become lodged between the drum surfaces and the belt segments as the latter are transported over the former. This is an advantage that derives from the present drive system in that it is not necessary to provide a hard, high friction surface to the drums since they are not used for driving the photoconductive carrying belt 12. Instead, a coating or layer 153 of low friction material, such as Teflon, or the like, is applied to the outer belt contacting surface of the drums. Although this coating could be applied to the inner surface of the belt 12, or to both the belt's outer surface and the contacting surface of the drums, it is preferred for manufacturing ease, to apply it to just the drums and this has been found sufficient.

Referring again to FIG. 9, it can now be appreciated that the belt segment 15 is formed from a sheet 17 which has an upper surface on which the photoconductive layer 19 is placed substantially uniformly over a continuous portion thereof, and an inner surface which the drums 70, 72 contact. The longitudinal edges of the sheet 17 are parallel to one another and form the side edges of the belt 12 and the transverse edges of the belt segment 15 are formed by bending downward and inward, at a sharp angle to the segment 15, the marginal portions 146 and 148 of the sheet 17 so that they underlie the bottom surface as best seen in FIG. 11.

The following description illustrates the steps required by an operator to mount the belt segments 15 on the assembly 16.

First, the operator releases the locking mechanism (not shown) securing the assembly in the copying machine in which the photoconductive belt is employed, by turning the handle 81. Next, the assembly is slid outwardly of the machine on guides or sliders 77, 79 (FIG. 3) so that the assembly is accessible.

Figure 12:
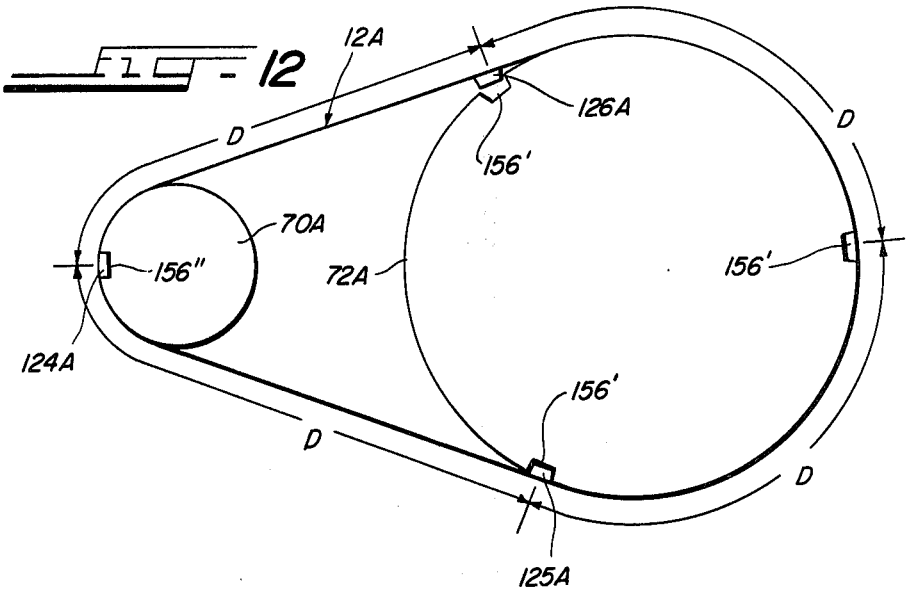
FIGS. 12, 13 and 14 are each schematic side views of different alternative constructions for the belt mounting and transport assembly of the present invention.

Once in the above-mentioned position, the handle 95 is rotated 180° in a counter-clockwise direction as illustrated in FIG. 3, to move drum 72 from an operative position, spaced predeterminedly from drum 70, to an inoperative position nearer drum 70. When this occurs, chains 120, 122 of the assembly are relaxed. Once in a relaxed position, segments 15 comprising the endless belt 12, can be easily mounted between tow bars 122, 124. To mount the segments, a first end 146 of a first segment 15 is inserted into a groove 142 of a first tow bar 122, and the opposite end 148 of the segment is inserted into a groove 144 of the other tow bar 124 (FIG. 12). The other segment 15 is mounted similarly. Thus, one end of each of the segments is held in the movable bar section 130 of the tow bar so that the belt segment will be properly tensioned upon moving the drum 72 back to its operative position.

It is preferred that the gap or opening between the segment 15, (See FIG. 11) be bridged by a layer of conductive tape to prevent toner from accumulating between the marginal portion 146 and 148 and the operator can place this tape at this point in the belt mounting procedure.

After the segments have been successfully mounted on the tow bars and drum 70 returned to an operative position, the assembly 16 is returned to its position in the copying machine and is ready for making copies.

As explained heretofore, the preferred embodiment of the assembly 16 includes a pair of drums 70, 72 having equal circumferential lengths and two belt segments 15, also of equal lengths. A pair of tow bars is employed with the center-to-center distance therebetween (pitch) being substantially equal to the length of one belt segment. Also, each drum includes a single recess for receiving a tow bar as it becomes aligned therewith. In the particular arrangement shown, each tow bar will be received in a recess in one of the drums simultaneously as the belt is transported over the path 14 (see FIG. 3). Thus, in the preferred embodiment of the assembly, the circumferential length of the drum is equal substantially to the pitch or center-to-center distance between the tow bars.

In accordance with another aspect of the present invention, it is possible to provide an assembly which includes a single belt segment or a number of belt segments and/or drums the latter of which may or may not have diameters of equal value and thus a greater number of tow bars. In such arrangements, the belt segment length or distance between tow bars must equal a multiple (2×, 3×, etc.) or submultiple ($\frac{1}{2}$×, $\frac{1}{3}$×, etc.) of the circumference of the smallest diameter drum of the assembly and the assembly must include two or more drums wherein the diameters of the drums have a multiple or submultiple relation to each other. In such arrangements, it is also possible that more than one recess will be required in a drum surface. If this is necessary, the situation may occur wherein a belt segment may be transported over a drum surface across an unfilled recess. This is a disadvantage especially wherein the section of the belt crossing the recess includes an image since improper development or transfer of the image can occur. Even if the area is not an image area, there is a chance that the photoconductive layer may crack or split because of sharp curving of the belt at the edges of the recess. Furthermore, the metallic belt segment may become creased. As such, it is undesirable to have unfilled recesses over which a belt segment is transported.

As mentioned above, the size of the drums need not be the same. For example, they could be, as shown in FIG. 12, a larger drum 72A which is three times the circumference of a smaller drum 70A. In this case, three channels 156" are provided in drum 72A to receive tow bars 124A, 125A, 126A, which are spaced apart a distance D which is equal to the circumference of the smaller drum 70A, which has a single channel 156'. The belt 12A can be made up of four segments 15 or two segments and the intermediate tow bars serve only to fill a channel and provide backing support for the belt but, of course, do not retain an end of the segment 15. As mentioned above, there cannot be a precise match to the rate of curvature of one or the drum 70A or 72A by the tow bars 124A, 125A, 126A, upper surfaces. The difference can be minimized by having the tow bar sections pivot slightly along their junction in response to the shape of the recesses, so as to more closely approximate the shape of each surface.

Figure 13:
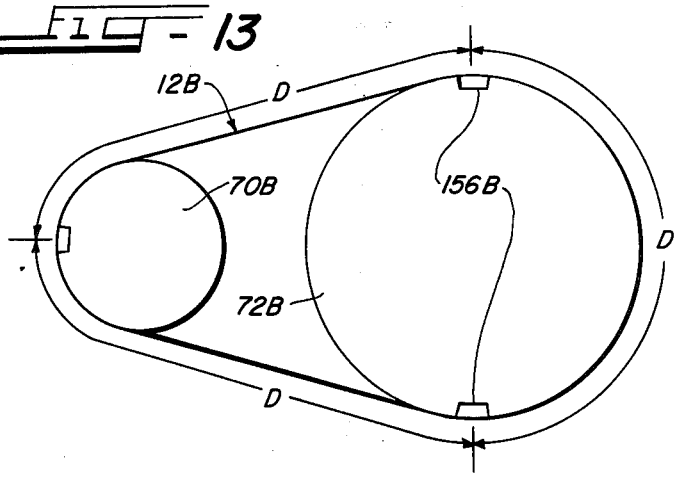

In FIG. 13, another alternative is illustrated wherein drum 72B is twice the circumference of drum 70B and is provided with two channels 156B to accommodate the tow bars. In this case, the belt 12B is made up of three segments 15.

Figure 14:
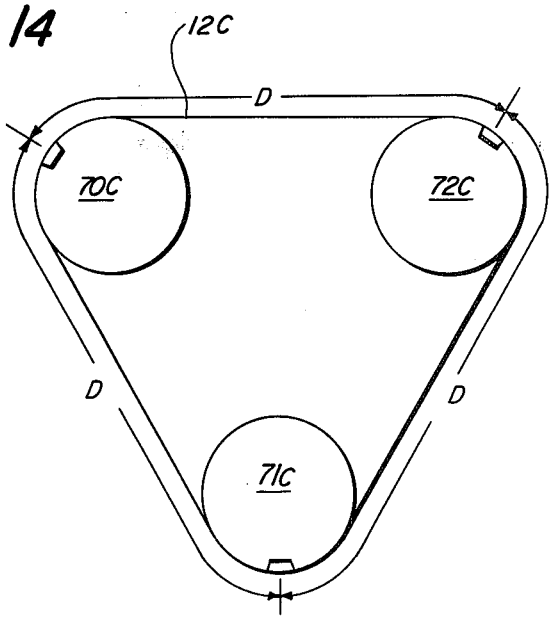

In FIG. 14, a three equal circumference drum alternative is illustrated using a three segment belt 12C, each of which segment is equal in length to the circumference of the drums 70C, 72C or 71C.

It should be noted that the drums serve to support the belt 12 but that the drive for the belt is achieved by means of the chains 120, 122 and tow bars 124, 126. This arrangement coupled with the teflon or like surface of the drums 70, 72 allows for the belt 12 to slip sidewise to accommodate minor misalignment due to manufacturing tolerance or wear. This construction avoids the problem of "walking" or the tendency of a fast moving belt to travel laterally on rollers, without any of the complex equipment or close tolerance construction that would be true for a non-segmented belt driven by a smooth drum or roller such as 70 or 72.

The use of a belt segment 15 that is formed into a belt by an edge joining by means such as the tow bar 126, has the advantage of ease of manufacture, as well as storage and shipping, over a endless belt, since it can be maintained in a flat array prior to use.

The belt mounting and transport assembly 16 according to the invention provides a highly reliable and efficient means for supporting and transporting an endless photoconductive belt member comprising belt segments about a path past the copying stations of a xerographic or the like type copying machine. Because the assembly maintains the photoconductive belt in a fixed relation on the endless belts or chains used to transport it, the initiation of copying operations can be reliably predicted in conjunction with the positioning at given locations of predetermined areas of the belt. As such, accurate imaging on the photoconductive belt surface can be maintained.

It should now be apparent that a new and useful copying machine photocopier belt assembly and assembly for mounting and transporting the belt assembly has been described, which has advantages over the prior art. While particular embodiments have been described, it will be obvious to those skilled in the art that changes and modifications may be made without departing from the invention in its broader aspects and, therefore, the aim in the following claims is to cover all such changes and modifications as fall within the contribution of this invention to the art.

What we claim is:

1. An assembly for mounting and transporting at least two belt segments forming an endless belt member in a copying machine for movement past copying stations for producing an image on the surface of said belt member, said assembly comprising:

at least two cylindrical drums, each having a predetermined diameter wherein the diameter of any one of the drums of said assembly is equal to or one of a multiple and submultiple of any other of the diameters of the drums of said assembly, said drums being spaced from each other a predetermined distance with the axes thereof in substantially parallel alignment, first and second endless guide means entrained about the opposite ends of said drums, respectively, for movement along predetermined parallel paths in response to the rotation of said drums, and tow bar means coupled at opposite ends to said first and second guide means, respectively, and extending therebetween, and coupling means for attachment of the ends of said belt segments to said tow bar means with said belt segments entrained about the surfaces of said drums, each of said drums including an axially extending recess formed in the surface thereof for receipt of said tow bar means therein as the latter is transported about the surfaces of said drums, the length of said belt segments being equal to or one of a multiple and submultiple of the circumference of the smallest diameter drum of said assembly to ensure direct engagement of said belt segments with said drum surface.

2. An assembly as claimed in claim 1 comprising a pair of cylindrical drums, each having a similar diameter, a pair of tow bars coupled to said first and second endless guide means at first and second locations and first and second belt segments attached between said tow bars in end-to-end relation, the length of each said belt segments being substantially equal to the distance between said tow bars and to the circumference of one of said cylindrical drums.

3. An assembly as claimed in claim 1 wherein the total number of recesses formed in all of the cylindrical drums of said assembly is equal to the number of tow bars secured to said first and second endless belt means.

4. An assembly as claimed in claim 3 wherein the number of belt segments is equal to the number of tow bars included in said assembly.

5. An assembly as claimed in claim 1 wherein at least one of the engaging surfaces of said drums and said belt segments includes a low friction material on the drum surfaces.

6. An assembly as claimed in claim 1 wherein an outer surface of each of said drums is formed of a material sufficiently soft to absorb pressure caused by foreign objects which become lodged between said belt segments and said drum surfaces as the former is transported over the latter, to minimize damage to the surface of said belt segments.

7. An assembly as claimed in claim 1 wherein said tow bar means includes a pair of bar members coupled together along the lengths thereof and spring biased toward each other, each said bar member defining a reverse groove extending the length thereof and the ends of said belt segments being reversely bent for receipt in the grooves of said tow bar members whereby said belt segments are attached to said tow bar means, said biasing spring tensioning the belt segments.

8. An assembly as claimed in claim 7 wherein the outer surfaces of said tow bar members is curved to approximate the curvature of the surface of the cylindrical drum of said assembly having the shortest diameter.

9. An assembly as claimed in claim 1 wherein at least one of said drums is mounted for movement between an operative position whereat said drums are spaced from each other said predetermined distance and an inoperative position whereat the distance between said drums is predeterminedly less than said predetermined distance, thereby to provide slack in said first and second guide means for attaching the ends of said belt segments to said tow bar means.

10. An assembly as claimed in claim 9 further including a locking assembly coupled to said one drum for locking the latter in said first and second positions, respectively.

11. An assembly as claimed in claim 1 wherein said belt segments is formed of a relatively thin sheet of metal which has applied thereto a photoconductive layer for imaging.

12. An assembly for mounting and transporting belt segments formed of relatively thin sheet metal which has applied thereto a photoconductive layer for imaging comprising an endless belt member, in a copying machine for movement past copy stations for producing an image on the surface of said belt member, said assembly comprising:

a plurality of cylindrical drums each having a similar circumferential length, said drums being spaced from each other a predetermined distance with the axes thereof in substantial parallel alignment, first and second endless guide means entrained about the opposite ends of said drums for movement along predetermined parallel paths in response to the rotation of said drums, at least one tow bar coupled at the ends thereof to said first and second guide means, respectively, and extending therebetween, and coupling means for attachment of the ends of said belt segments to said tow bar, each said drum including a recess formed therein extending parallel to the axis thereof for receipt of said tow bar as the latter is transported about the surface of said drum whereby the endless belt member is transported over in direct engagement with the drum surface, the length of said belt segments being equal to one of a multiple and submultiple of the circumference of one of said drums.

13. An assembly for mounting and transporting a plurality of belt segments forming an endless belt member in a copying machine for movement past copy stations to produce an image on the surface of said belt member, said assembly comprising:

a plurality of cylindrical drums each having a predetermined diameter, the diameter of any one of said drums being equal to or one of a multiple and submultiple of any other of the diameters of said drums of said assembly, said drums being spaced from each other a predetermined distance with the axes thereof in substantial parallel alignment, first and second endless guide means entrained about the opposite ends of said drums for movement along predetermined parallel paths in response to the rotation of said drums, and a plurality of tow bars equal in number to the belt segments comprising the belt member, coupled at the ends thereof to said first and second endless guide means, respectively, and coupling means for attachment of the ends of said belt segments to said tow bars, said segments extending between said tow bars in end-to-end relation, each said drum including a recess formed in the surface and extending axially thereof for receipt of a tow bar therein as the latter is transported about the surface of the drum, whereby the belt segments are maintained in direct engagement with the drum surfaces, the center-to-center distance between adjacent tow bars being substantially equal to one of a multiple and submultiple of the circumference of the smallest diameter drum of said assembly, thereby to ensure the alignment of said tow bars with said recesses as the former pass over the surfaces of said drums.

14. An assembly as claimed in claim 13 wherein the total number of recesses provided in the drums of said assembly is equal to the number of tow bars in said assembly.

15. A copying machine comprising an endless photoconductive belt member formed of at least two belt segments arrayed end to end and transported along an endless path past various copying stations including means for charging and exposing the surface of said belt member to create thereon a charge image, means for developing said image and means for transferring the developed image to a sheet of copy material and means for forcing the transferred image thereon, an assembly for mounting said photoconductive belt member including in combination:

at least two cylindrical drums, each having a predetermined diameter and wherein the diameter of any one of the drums is equal to or one of a multiple and submultiple of any other of the diameters of the drums of said assembly, said drums being spaced from each other a predetermined distance with the axes thereof in substantially parallel alignment therewith, first and second endless guide means entrained about the opposite ends of said drums, respectively, for movement along predetermined parallel paths in response to the rotation of said drums, at least two tow bar means, one for each belt segment coupled at opposite ends to said first and second guide means, respectively, and extending therebetween, and coupling means for attachment of the abutting ends of said belt segments to said tow bar means with said belt segments entrained about the surfaces of said drums, each of said drums including an axially extending recess formed in the surface thereof for receipt of said tow bar means therein as the latter is transported about the surfaces of said drums, to ensure direct engagement of said belt segments with said drum surface, the length of said belt segments being equal to or one of a multiple and submultiple of the circumference of the smallest diameter drum of said assembly, and wherein said developing means is located adjacent one of said drums of the assembly for applying developer to a charge image found on the surface of said belt segments as the latter is transported over the surface of one drum.

16. An assembly as claimed in claim 15 wherein said transfer means is located adjacent a second one of said cylindrical drums of said assembly for transferring the developed image formed on the surface of said belt segments as the latter is transported over the surface of said second one of said drums.

17. An assembly as claimed in claim 15 comprising first and second cylindrical drums, each having a similar circumferential length, said tow bars are coupled to said first and second endless guide means at predetermined spaced locations thereabout and the equal number of belt segments attached to said tow bars and extending therebetween in end-to-end relation, the length of each of said belt segments being substantially equal to or one of a multiple and submultiple of the circumference of one of said cylindrical drums.

18. A unit for forming a photoconductive layered belt for passing about drums and gripped by a tow bar in a copying machine, comprising:

a thin layer of conductive metal forming a substrate sheet for a photoconductive layer, said sheet having a top surface, a bottom surface, transverse edges and parallel longitudinal edges and being resiliently flexible along its longitudinal direction so as to be able to bend about the drums of the copying machine;

a layer of photoconductive material bound at the top surface of said sheet to said sheet and covering in a substantially uniform manner at least a major portion of said top surface; and said sheet having affixing projections formed along the transverse edges thereof which extend away from the sheet surface on the bottom side thereof and are adapted for being gripped by the tow bar of the copying machine.

19. The invention of claim 18 wherein said transverse edges lie at a right angle to the longitudinal edges and said affixing projections are formed so as to provide a uniform cross sectional profile along the transverse edges.

20. The invention of claim 18 wherein said affixing projections are formed unitarily with the sheet by non-resiliently bending the transverse marginal portions thereof to a sharp angle from the sheet surface to project backwards and underlie the bottom surface of the sheet.

21. In a xerographic copier: an endless moving belt which has a photoconductive area on one surface and a drum contacting surface;

at least two drums about which said belt travels, said drums defining belt contacting surface against which said belt is in contact; and means provided on at least one of said contacting surface for allowing easy lateral slippage of the belt on the drum.

22. The invention of claim 21 wherein the means provided for allowing easy lateral slippage of the belt on the drum is applied to the drum contacting surface.

23. The invention of claim 21 wherein said means provided for allowing easy lateral slippage includes a teflon coating of the drum contacting surface.

24. In a xerographic copier the improvement of:

an endless moving belt which has a photoconductive area on an outer surface and a drum contacting inner surface;

at least two drums about which said belt travels, said drums defining a belt contacting surface against which said belt makes contact; and cushion means provided at at least one of said contacting surfaces for allowing small articles to pass between said surfaces without deforming said belt.

25. In a xerographic copier of the type which exposes an image on a charged photoconductive surface of a moving longitudinally resilient, flexible belt which belt thereafter is used to transfer a developed image to copy paper, the improvement comprising:

providing the belt with at least one transverse break;

a tow bar means having longitudinally extending first and second members mounted for relative movement in a generally transverse direction for releasably engaging the edges of the transverse break, spring means urging the first and second members of said tow bar means toward each other to maintain said belt segment under substantial tension and prevent disengagement of said belt segment edges from said two-piece tow bar means during driven movement; and drive and belt guiding means for driving the tow bar about a non-circular path and for carrying the moving photoconductive surface carrying belt thereby over that path in a continuous non-stop manner whereby numerous copies may be made by exposing an image on successive portions of the moving belt, which portions do not include the break area, and developing copies on paper therefrom.

26. The invention of claim 25 wherein said drive means include a non-expanding flexible endless guide member and means for driving that member over a fixed path.

27. The invention of claim 26 wherein said endless guide member is a chain whose fixed path is defined by a plurality of sprocket wheels.

28. The invention of claim 25 wherein said tow bar means comprises:

a first and second elongated bar section each of which serves to hold a different transverse edge of the belt;

means for providing alignment and for securing the first and second bars together, but allowing them to move over a limited range relative to one another; and spring means for providing the mechanical bias for urging the first and second bars together.

29. The invention of claim 28 wherein said means for providing alignment and for securing includes a plurality of adjustable connectors at spaced intervals along the bar which connectors are manually adjustable to change the range of movement of the bars toward each other and said spring means are seated against the connectors so that the mechanical bias can also be changed by manually adjusting the connectors.

30. A xerographic copier comprising:

a station from which an image of an original may be taken;

means for projecting the image of the original to an exposure area;

an endless belt of a conductive substrate having a photoconductive layer on a portion of its outer surface, said belt being mounted for movement about a path so that the outer surface passes through the exposure area;

means for electrostatically charging the photoconductive layer upstream of the exposure area;

means for applying toner to the moving belt downstream of the exposure area;

means downstream of the toner application means for supplying plain paper and transferring the toner from the belt to the paper;

means for fixing the toner to the paper;

belt mounting and driving means including a tow bar affixed across the belt at the inner surface thereof, two cylindrical drums about which the belt travels, one of said drums being larger than the other by a cylindrical circumference to circumference ratio of three, said drums including means for receiving said tow bar without causing the belt to excessively bend, and means for driving the tow bar about the belt path, whereby the belt may travel the path over the drums without excessive "walking" and xerographic copies may be made in a rapid and effective manner.

31. A xerographic copier comprising:

a station from which an image of an original may be taken;

means for projecting the image of the original to an exposure area;

an endless belt of a conductive substrate having a photoconductive layer on a portion of its outer surface said belt being mounted for movement about a path so that the outer surface passes through the exposure area;

means for electrostatically charging the photoconductive layer upstream of the exposure area;

means for applying toner to the moving belt downstream of the exposure area;

means downstream of the toner application means for supplying plain paper and transferring the toner from the belt to the paper;

means for fixing the toner to the paper;

belt mounting and driving means including a tow bar affixed across the belt at the inner surface thereof, two cylindrical drums about which the belt travels, one of said drums being larger than the other by a cylindrical circumference to circumference ratio of two, said drums including means for receiving said tow bar without causing the belt to excessively bend, and means for driving the tow bar about the belt path, whereby the belt may travel the path over the drums without excessive "walking" and xerographic copies may be made in a rapid and effective manner.

* * * * *